United States Patent [19]

Mizunuma et al.

[11] Patent Number: 4,482,154

[45] Date of Patent: Nov. 13, 1984

[54] GAME APPARATUS WITH MOVING OBJECTS

[75] Inventors: Masanori Mizunuma; Hiroyuki Watanabe, both of Tokyo, Japan

[73] Assignee: Tomy Kogyo Co., Inc., Japan

[21] Appl. No.: 376,022

[22] Filed: May 7, 1982

[51] Int. Cl.[3] ..... A63F 9/08

[52] U.S. Cl. ..... 273/153 S

[58] Field of Search ..... 273/153 S

[56] References Cited

U.S. PATENT DOCUMENTS

| | | | |
|---|---|---|---|
| 483,276 | 9/1892 | Anderson | 273/153 S |
| 509,362 | 11/1893 | Casler | 273/153 S X |
| 590,093 | 9/1897 | Du Bois | 273/153 S |
| 614,988 | 11/1898 | Sanborn | 273/153 S UX |
| 619,804 | 2/1899 | Svanstrom | 273/153 S |
| 814,653 | 3/1906 | Healey . | |
| 3,706,457 | 12/1972 | Gonzales et al. | 273/153 S |
| 3,767,202 | 10/1973 | Sternad | 273/153 S |
| 3,843,131 | 10/1974 | Stubbmann | 273/153 S X |
| 4,208,052 | 6/1980 | Snow | 273/153 S X |
| 4,376,537 | 3/1983 | Yokoi | 273/153 S |

*Primary Examiner*—Anton O. Oechsle

*Attorney, Agent, or Firm*—K. H. Boswell; Edward D. O'Brian

[57] ABSTRACT

A game apparatus has a housing which includes a stationary element located on the housing and at least one movable element located on the housing in association with the stationary element. The stationary element includes members dividing the stationary element into a plurality of sections. The movable element includes members dividing the movable element into a plurality of sections, with the plurality of sections on the movable element equal in number to the plurality of sections on the stationary element. The movable element is movable with respect to the stationary element between three positions. In the central of these positions, one of the sections of the movable element is aligned with one of the sections on the stationary element and in moving the movable element in a first direction, the section on the movable element is aligned with the next adjacent section in the same direction on the stationary element, and by movement of the movable element in the opposite direction, the section on the movable element is aligned with the next adjacent section in the opposite direction on the stationary element. A plurality of objects of at least two different classes are located in the housing and movably positioned in the sections of the movable and stationary elements. The objects can be moved back and forth through the sections of the movable and stationary elements by moving the movable element with respect to the stationary element.

10 Claims, 6 Drawing Figures

GAME APPARATUS WITH MOVING OBJECTS

BACKGROUND OF THE INVENTION

This invention is directed to a game apparatus wherein a plurality of objects of different classes are moved within the apparatus by moving the objects back and forth in sections on a stationary element and a movable element associated with it. More specifically, this invention is directed to a gaming apparatus wherein a linear array of sections on a stationary element are aligned with an array of sections on a movable element and the objects are moved to rearrange them with respect to one another by moving back and forth between the movable and stationary elements.

A class of games or puzzles are known wherein a plurality of objects are rearranged with respect to their order within a housing. This general type of game has held the interest of the consuming public for well over one hundred years, as is represented by U.S. Pat. No. 230,947 issued in 1880 and U.S. Pat. No. 4,208,052 issued in 1980. During the intervening century, other patents, such as U.S. Pat. No. 483,276; U.S. Pat. No. 814,653; U.S. Pat. No. 590,093; U.S. Pat. No. 619,804; U.S. Pat. No. 3,767,202 and U.S. Pat. No. 3,706,457 have been issued to this class of games.

As is evident by the representative examples listed above, the members of this class of games or puzzles are exceedingly popular because they are interesting and challenging to the players of the same, and provide not only a recreational outlet to the player of the game, but also provide a mental stimulation. It is believed that, because of the combination of these two factors, the general class of games as outlined above have retained their popularity for many years and will continue to do so in the future.

BRIEF DESCRIPTION OF THE INVENTION

In view of both the mental and recreational aspects of the general class of games or puzzles outlined above, it is believed that there exists a need for new members of this class of games or puzzles. It is therefore a broad object of this invention to provide such new members to this general class of games or puzzles. It is a further object to provide a game apparatus which can be utilized to provide both a recreational outlet and a mental stimulation in utilizing the game apparatus. It is a further object to provide a game apparatus which because of its engineering and mode of operation is adaptable to both simple, economical game apparatuses and more complex game apparatuses relying on the same principle but which provide greater mental challenge for more sophisticated persons.

These and other objects, as will become evident from the remainder of this specification are achieved in a game apparatus which comprises a housing; a stationary element located on said housing, said stationary element including means dividing said stationary element into a plurality of sections; a first movable element located on said housing in association with said stationary element, said first movable element including means dividing said first movable element into a plurality of sections equal in number to the number of sections on said stationary element, said first movable element movable with respect to said stationary element such that in a first position one of said sections on said first movable element is in alignment with one of said sections on said stationary element and in a second position said one of said sections on said first movable element is in alignment with the next adjacent section of said stationary element located on one of the sides of said one of said sections on said stationary element and in a third position said one of said sections on said first movable element is in alignment with the next adjacent section on said stationary element located on the other side of said one of said sections on said stationary element; a plurality of objects of at least two different classes located on said housing and movably positionable on said sections of said first movable element and said sections of said stationary element, said objects capable of being moved back and forth between said sections on said first movable element and said sections on said stationary element and said objects movable from any of one of said sections of said stationary element to a next adjacent section of said stationary element by moving said objects from one of said sections on said stationary element to one of said sections on said first movable element and moving said objects with respect to said one of said sections on said stationary element by moving said first movable element with respect to said stationary element followed by moving said object from said first movable element to the next adjacent section on said stationary element after completion of said movement of said first movable element with respect to said stationary element.

The game apparatus as noted in the preceding paragraph can be improved by providing a second movable element located on the housing, also in association with the first stationary element. The second movable element would also be divided into sections wherein the number of sections on the second movable element would be equal in number to the number of sections on the stationary element. The sections of the second movable element would be positionable with respect to the sections of the stationary element as were the sections of the first movable element. Further, the plurality of objects would be movably positionable in the sections of the second movable element and movable between the second movable element and the stationary element in the same manner as they were with respect to the first movable element and the stationary element.

Preferredly, the sections on the stationary element would comprise sections arranged in an array on the stationary element with each of the sections on the stationary element having two open ends. The first and second movable elements would be located with respect to the stationary element such that the first movable element would move along one of the ends of each of the sections of the stationary element and the second movable element would move along the other of the ends of the sections of the stationary element.

Preferredly, the sections of the stationary elements would be linear sections arranged in an array such that they are parallel with respect to one another on the stationary element. Each of the sections of the stationary element would be capable of containing at least two of the objects with each of the sections on the first and second movable element capable of containing at least one of the objects. In a more preferred embodiment of the invention each of the sections of the first and second movable element would be capable of containing one of the objects and each of the sections on the stationary element would be capable of containing at least all but one of the members of one of the classes of objects.

Preferredly, a retaining means would be associated with the first and second movable elements and would be capable of interchangeably retaining the first and second movable elements in the respective first, second and third position. Means would be associated with each of the first and second movable elements allowing the first and second movable elements to be moved by the digits of the player of the game apparatus.

Preferredly, the retaining means would include both a biasing means and a positioning means with the biasing means interacting with the positioning means to interchangeably hold each of the first and second movable elements in the respective first, second and third positions. More preferredly, a first and second biasing means and a first and second positioning means would be present with the first biasing means and the first positioning means operatively associated with the first movable member and the second biasing means and the second positioning means operatively associated with the second movable member.

Preferredly, the first and second positioning means would include a first locating means having indentations located thereon corresponding to the first, second and third positions of the first and second movable members, respectively, and a follower means capable of fitting sequentially into each of the indentations. The biasing means would be associated with the follower means to bias the follower means into the respective indentations.

Preferredly, the number of classes of the object would be equal to at least the number of the sections of the stationary element such that the object of the game would be to locate all of the members of one of the classes of the objects in each of the sections of the stationary element.

DETAILED DESCRIPTION OF THE DRAWINGS

The invention described in this specification will be better understood when taken in conjunction with the drawings wherein.

Figure 1:
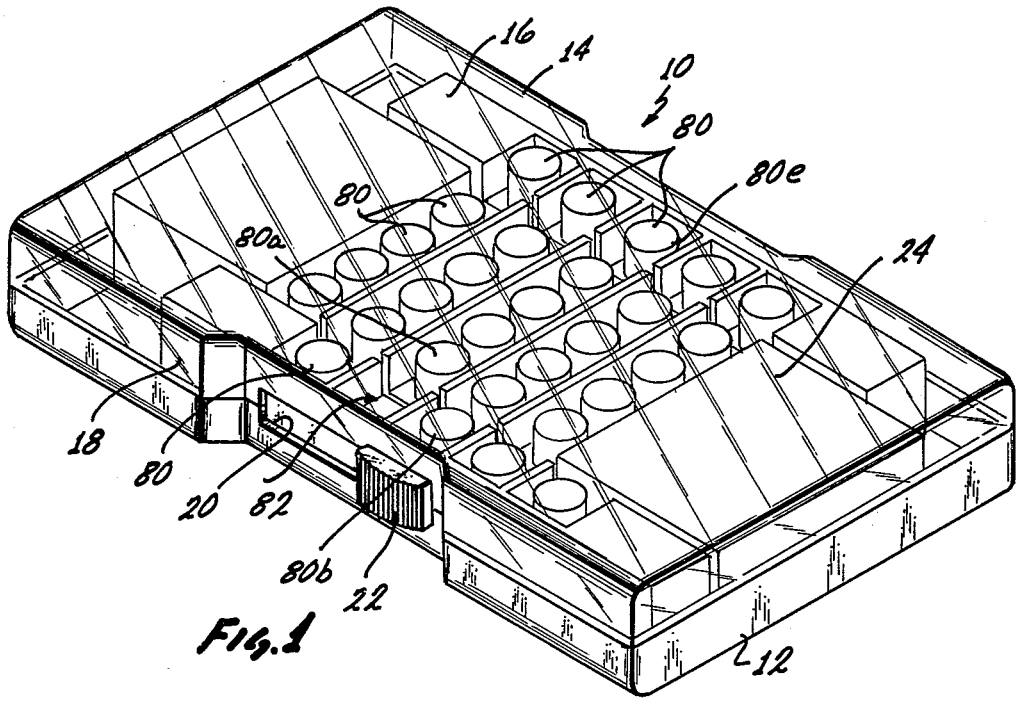
FIG. 1 is an oblique view of the game apparatus of the invention.

The invention described in this specification and illustrated in the drawings utilizes certain principles and/or concepts as are set forth in the claims appended to this specification. Those skilled in the toy arts will realize that these principles and/or concepts are capable of being utilized with a variety of embodiments differing from the illustrated embodiments herein. For this reason, this invention is not to be construed as being limited to the illustrated embodiments illustrated herein, but is to be construed as being limited only with respect to the claims.

DETAILED DESCRIPTION OF THE INVENTION

Game apparatus 10 as illustrated in the Figs. has the following component parts which are visible from the outside. A bottom housing 12 supports the game, and together with a transparent top housing 14 form the outside surface of the game. Located within the interior of the bottom and top housings 12 and 14 are a right side slide member 16 and a left side slide member 18. A slot on both the right and left hand sides, only the slot 20 being visible on the left hand side of FIG. 1, is formed between the top and bottom housing members 14 and 12 such that projection 21 on the right slide member and a similar projection 22 on the left side member are exposed outside of the housing. The projections 21 and 22 allow for movement of the right and left slide members 16 and 18.

Figure 3:
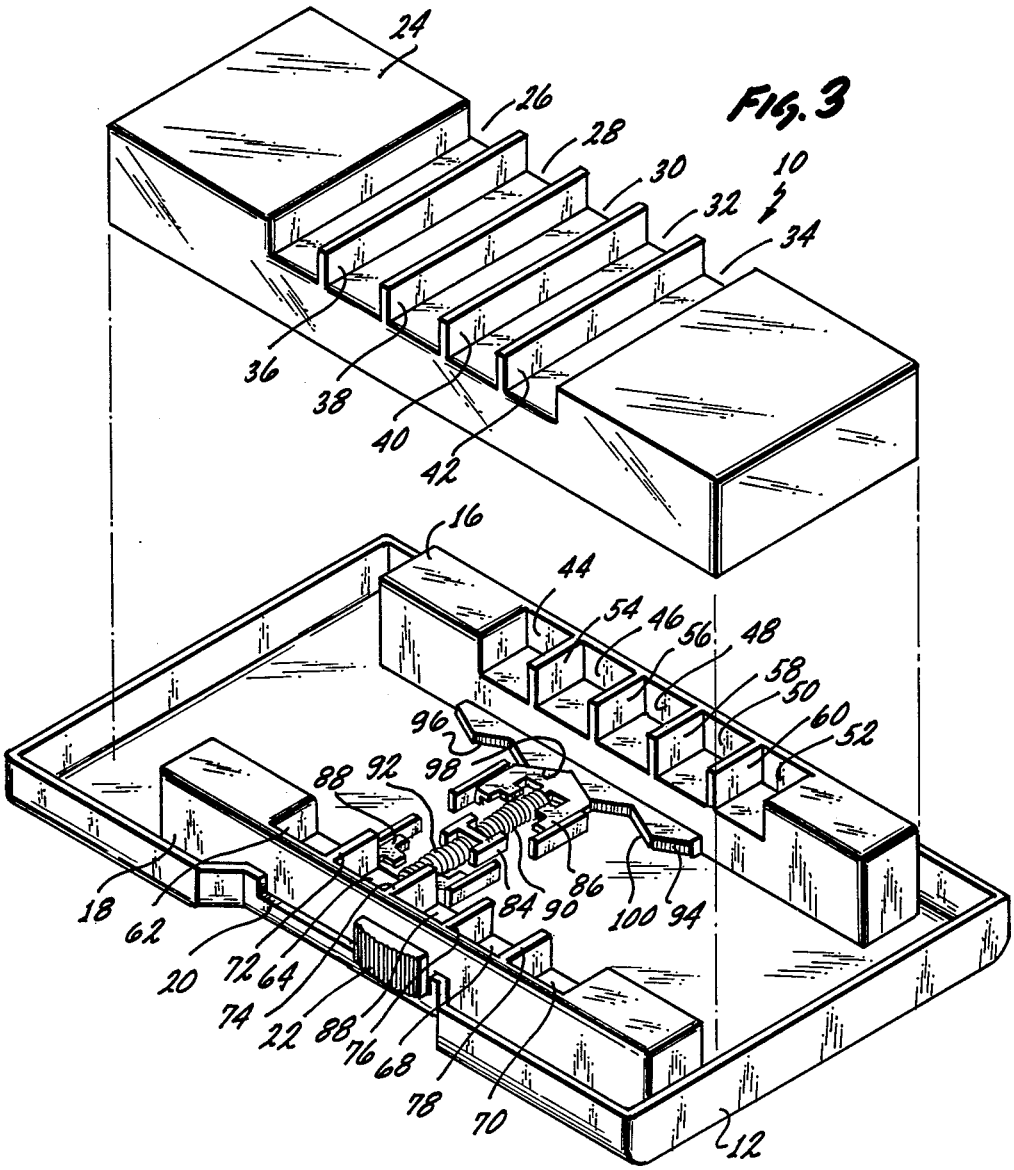
FIG. 3 is an oblique exploded view showing further overlaying components removed and one of the remaining components exploded from the remainder of the components thereof.

A central element 24, as is best seen in FIG. 3 is located within the game apparatus 10 between the right and left slide members 16 and 18. The central element 24 contains a plurality of sections 26, 28, 30, 32 and 34 which are formed by baffles 36, 38, 40 and 42, respectively.

The right slide member includes sections 44, 46, 48, 50 and 52 which are formed by baffles 54, 56, 58 and 60. Likewise, the left side slide member includes sections 62, 64, 66, 68 and 70 which are formed by baffles 72,74, 76 and 78.

A plurality of objects, collectively identified by the numeral 80, and in certain instances, hereinafter identified with an alphabetical letter after the numeral 80, are located in the respective sections on the central element 24 and the right and left hand side slide members 16 and 18. Each of the objects 80 is sized such that it is free to slide in any of the sections on the central element 24 or the right and left side slide elements 16 and 18. The sections 44, 46, 48, 50 and 52 on right side slide member 16 and the sections 62, 64, 66, 68 and 70 on left side slide member 18 are each capable of holding one of the objects 80 at any one time. The sections 26, 28, 30, 32 and 34 are capable of holding a number of the objects 80 at any one time.

The objects 80 are divided into particular classes. The classes are differentiated from each other by some sort of identifying indicia located on the objects 80, such as color coding the top of the objects 80 or otherwise rendering each of the members of one of the classes unique in some manner. In the embodiment of the invention depicted in FIGS. 1 and 2, the sections 26, 28, 30, 32 and 34 are each capable of holding four objects 80 at any one time. In other embodiments of the game, the number of objects capable of being located in these sections can be variable, depending upon the size of the game. It is understood, however, that as the number of objects which can be located in any one of the sections 26, 28, 30, 32 and 34 in the central element 24 increases, the complexity on playing the game also increases, in that it renders further permutations and combinations of the order of the members of the classes of the objects 80, as will be evident below. In any event, normally, in the preferred embodiments of the invention, each of the sections 26, 28, 30, 32 and 34 will be able to contain all but one of the members of any one of the classes of the objects 80. Thus, as depicted in the embodiment illustrated in FIGS. 1 and 2, wherein four of the objects 80 are located in the particular sections 26, 28, 30, 32 and 34 of the central element 24, there would be five members in each of the individual classes of the objects 80.

It is an object in utilizing the game apparatus 10 to mix up the order of the classes of objects 80 located within the game apparatus 10 and then, by manipulating the left and right slide members 16 and 18 back and forth with regard to the central element 24, to rearrange the order of the elements 80 such that all of the members of a class of the elements 80 are located in an alignment with respect to one another within sections 26, 28, 30,32 and 34 of the central element 24, plus the sections on one of the respective right or left side slide members 16 or 18. Alternately, other goals could be achieved, such as trying to locate one of each of the members of the different classes within one of the rows formed by the particular sections in the right and left side slide members in conjunction with the central element. It is evident that the game apparatus 10 is capable of being played in a variety of imaginative and different ways by the player of the game by so locating all the members of the classes of the objects 80 into different arrays.

Figure 2:
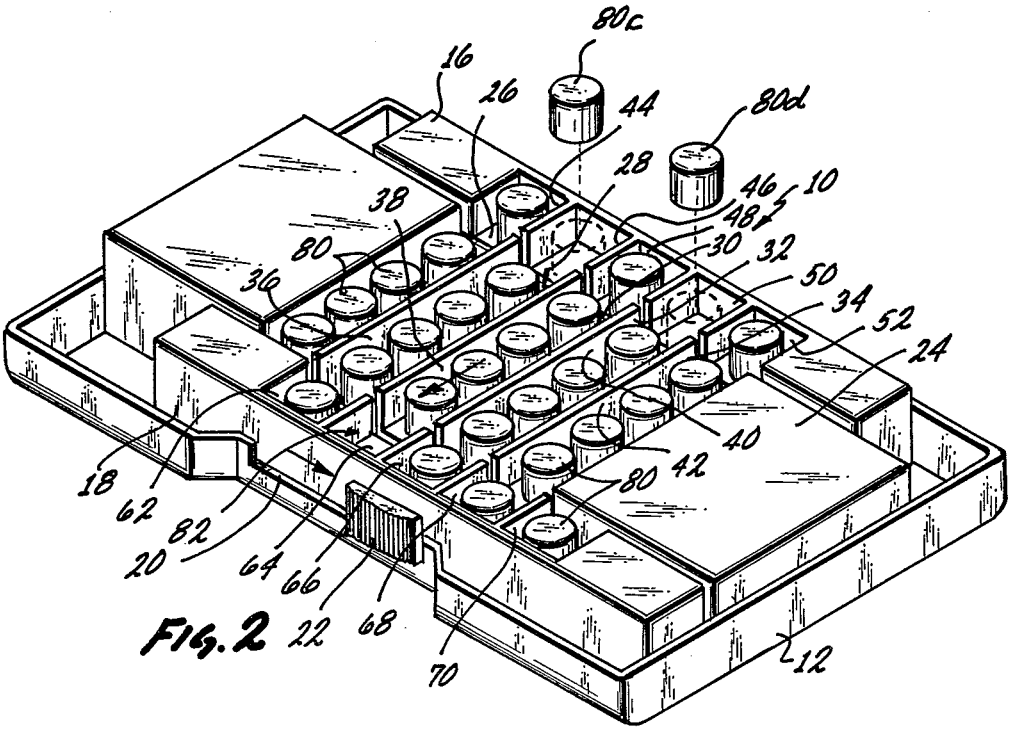
FIG. 2 is an oblique view similar to FIG. 1 with an overlaying component removed to show greater detail of components located underneath it.

The right and left side slide members 16 and 18 move with respect to the central element 24 such that, except for the end sections 26 and 34 on right side slide member 16 and 62 and 70 on left side slide member 18, each of the remaining sections 28, 30 and 32 on right side slide member 16 and 64, 66 and 68 on left side slide member 18 can be aligned with three adjacent sections 26, 28, 30, 32 or 34 on the central element 24. The end sections 26 and 34 on the right side slide member 16 and 62 and 70 on the left side slide member 18 can be aligned with two of the sections 26, 28, 30 32 or 34 on the central element 24, or against a section of the central element 24 such as is seen in FIGS. 1 and 2 for section 70.

The number of the objects 80 present within the game apparatus 10 will at all times be one less than the number of total objects which can concievably be located in all of the sections on the central element 24 plus the sections on the right side slide member 18 plus the sections on the left side slide member 18. Thus, a void, or open space, such as the space 82 as seen in FIGS. 1 and 2 is always present. In other embodiments of the game, more than one space such as the space 82 can be present. As the number of spaces left within the respective sections of the game apparatus 10 increases, the ease of rearranging the objects 80 into any particular array of classes also increases. With only one space, such as space 82 as is illustrated in FIGS. 1 and 2 being present, the difficulty for any particular number of objects 80 which can be contained within the game apparatus 10 is at its maximum. As was noted above, if the size of the game apparatus 10 is increased such that the number of objects 80 which can be contained therein and the classes these objects can be broken into increases, the difficulty of the game also increases.

Figure 5:
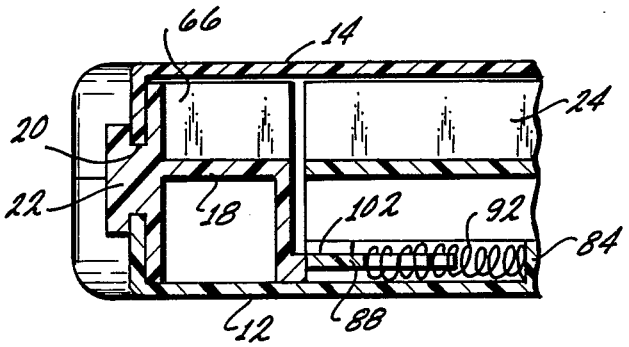
FIG. 5 is a partial sectional view about the line 5—5 of FIG. 4.
Figure 4:
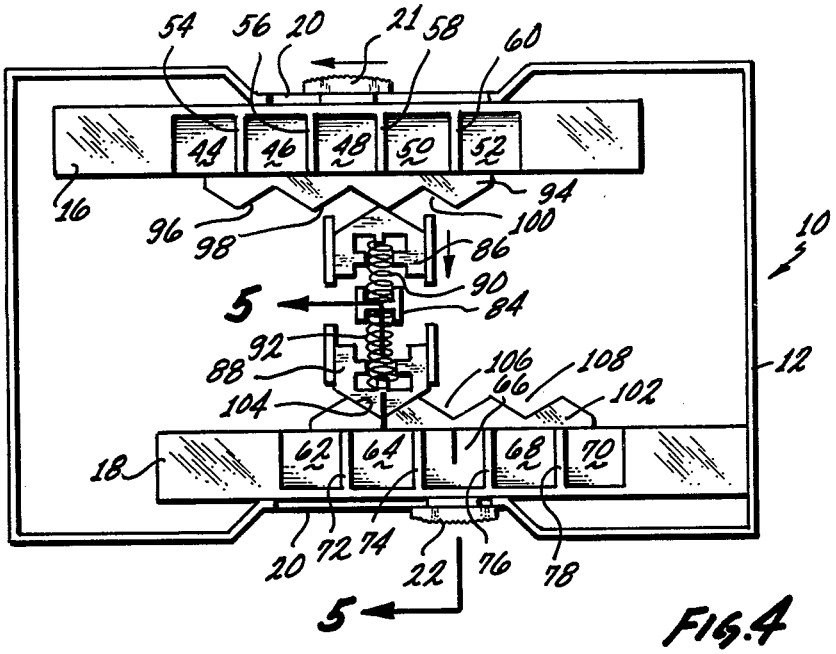
FIG. 4 is a top plan view of the embodiment of the invention shown in FIG. 3.

In FIGS. 3 through 5, the components located underneath the central element 24 are illustrated for two different embodiments. One embodiment is as depicted in FIGS. 3, 4 and 5, with an alternate embodiment depicted in FIG. 6. Both of these embodiments utilize the same principle of operation in holding the right and left side slide members 16 and 18 in the three positions with respect to the sections 26, 28, 30, 32 and 34 on the central element 34.

In the embodiment of FIGS. 3 through 5, an "H" shaped projection 84 is formed as an integral part of the bottom housing 12. A first detent member 86 is located on one side of projection 84 and a second detent member 88 is located on the other. Detent member 86 is biased away from projection 84 via spring 90, while detent member 88 is biased away from projection 84 by spring 92.

Formed as an integral part of right side slide member 16 is an element 94 having three indentations 96, 98 and 100. Likewise, an element 102 formed as an integral part of left side slide member 18 has three indentions 104, 106 and 108. The detent member 88 fits into one of the indentions 96, 98 and 100 and the detent member 88 fits into one of the indentions 104, 106 or 108. As the right and left side slide members 16 and 18 are moved with respect to the central element 24, the detent members 86 and 88 respectively are moved against the biases of springs 90 and 92, respectively, as the members 86 and 88 move in the respective indentations 96, 98 and 100 or 104, 106 and 108. It can be seen that interaction of one of the detent members 86 or 88 with one of the indentions 96, 98 and 100 or 104, 106 and 108 reversibly holds either the right or the left side slide member 16 or 18 in one of their three positions. Movement of the slide members 16 or 18 between their three positions moves against the biases of springs 90 and 92 and, after said movement is accomplished, the biases of the springs 90 and 92 retain the slide members 16 and 18 in the respective positions until once again it is desired to move them by sliding the slide members 16 or 18 via interaction against the projections 21 and 22 located respectively on the right and left side slide members 16 and 18.

Figure 6:
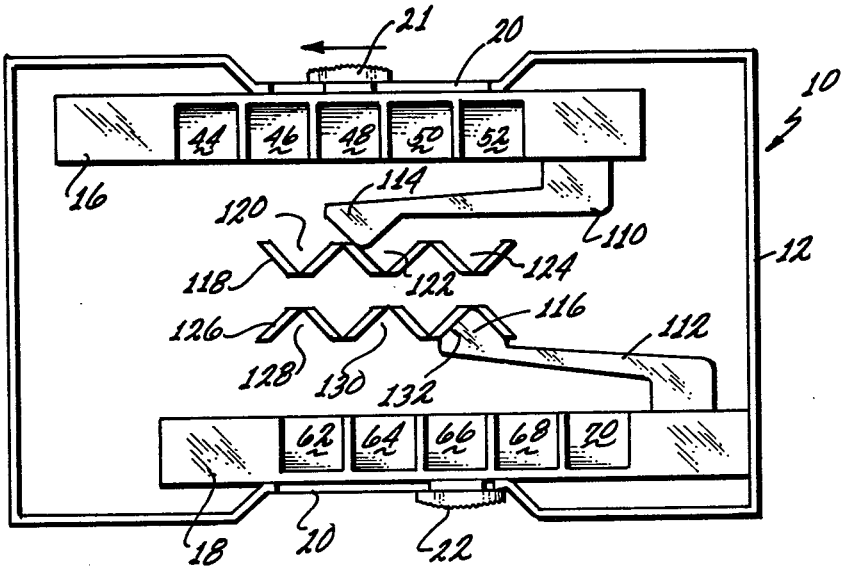
FIG. 6 is a top plan view similar to FIG. 4 with an alternate embodiment of the invention depicted therein.

In FIG. 6, an alternate embodiment is illustrated which accomplishes the same action of retaining the right and left side slide members 16 and 18 in their three positions. To accomplish this, a spring arm 110 is located on right side slide member 16 while an identical spring arm 112 is located on left side slide member 18. Spring arm 110 includes a detent 114 located on its end, and spring arm 112 has an identical detent 116 located on its end. Projecting upwardly and integrally formed with the bottom housing 12 are a series of baffles collectively identified by the numeral 118 which forms indents 120, 122 and 124 which interact with detent 114 on spring arm 110 and collectively identified by the numeral 126 are a series of baffles which form indents 128, 130 and 132, which interact with detent 116 on spring arm 112. Interaction of the respective detents 114 and 116 with respect to indents 120, 122 or 124 and 128, 130 or 132 position the slide members 16 and 18 in their three positions with respect to the central element 24. The bias in the spring arms 110 and 112 allow the detents 114 and 116 to reversibly slide back and forth between the indents 120, 122 and 124 or 128, 130 and 132.

In FIG. 1 it can be seen that the object identified by the numeral 80*a* can be moved from the central element 24 to the left side slide member 18 by moving it to the left into space 82. This would then create a new space in the position previously occupied by the object 80*a*. This new space could be taken up by sliding the remainder of the members in section 30 on central element 24 along with the object 80*e* in section 48 on right side slide member 16 to the left to create a space in section 48 on slide member 16 or slide member 18 could be slid upwardly and the object 80*b* could then be inserted into the space previously occupied by the object 80*a*. This of course, would create a new space in section 74 of left side slide member 18.

In FIG. 2 the objects 80*c* and 80*d* have been exploded upwardly to illustrate their shape and also to indicate that they are freely positionable on the right and left side slide members 16 and 18 and the central element 24.

I claim:

1. A game apparatus which comprises:

a housing;

a stationary element located on said housing, said stationary element including means dividing said stationary element into a plurality of sections;

a first movable element located on said housing in association with said stationary element, said first movable element including means dividing said first movable element into a plurality of sections equal in number to the number of section on said stationary element, said first movable element movable with respect to said stationary element such that in a first position one of said section on said first movable element is in alignment with one of said section on said stationary element and in a second position said one of said section on said first movable element is in alignment with the next adjacent section on said stationary element located on one side of said one of said sections on said stationary element and in a third position said one of said sections on said first movable element is in alignment with the next adjacent section on said stationary element located on the other side of said one of said section on said stationary element;

a plurality of objects of at least two different classes located on said housing and movably positionable in said section of said first movable element and said sections of said stationary element, said objects capable of being moved back and forth between said sections on said first movable element and said sections on said stationary element and said objects movable from any of one of said section of said stationary element to a next adjacent section of said stationary element by moving said objects from one of said sections on said stationary element to one of said section on said first movable element and moving said objects with respect to said one of said sections on said stationary element by moving said first movable element with respect to said stationary element followed by moving said objects from said first movable element to the next adjacent section on said stationary element after completion of said movement of said first movable element with respect to said stationary element;

a second movable element located on said housing in association with said first movable element;

said second movable element including means dividing said second movable element into a plurality of sections equal in number to the number of sections on said stationary element, said second movable element movable with respect to said stationary element such that in a first position one of said section on said second movable element is in alignment with one of said sections on said stationary element and in a second position said one of said sections on said second movable element is in alignment with the next adjacent section on said stationary element located on one of the sides of said one of said sections on said stationary element and in a third position said one of said section on said second movable element is in alignment with the next adjacent section on said first stationary element located on the other side of said one of said sections on said stationary element;

said sections on said stationary element comprising sections arranged in an array on said stationary element with each of said section having two open ends;

said first and said second movable elements located with respect to said stationary element such that said first movable element moves along one of the ends of said sections of said stationary element and said second movable element moves along the other of the end of said sections on said stationary element;

said plurality of objects movably positionable in said sections of said second movable element and movable between said second movable element and said stationary element in a manner analagous to movement between said first movable element and said stationary element.

2. The game apparatus of claim 1 wherein:

said sections of said stationary element are linear sections arranged in a parallel array on said stationary element.

3. The game apparatus of claim 2 wherein:

each of said sections on said stationary element are capable of containing at least two of said objects;

each of said sections of said first and said second movable elements are capable of containing at least one of said objects.

4. The apparatus of claim 3 wherein:

each of said sections on said first and said second movable elements are capable of containing one of said objects;

each of said sections on said stationary element are capable of containing at least all but one of the members of one of said classes of objects.

5. The game apparatus of claim 4 wherein:

the number of said classes of said objects is equal to at least the number of said sections on said stationary element.

6. The game apparatus of claim 5 including:

retaining means associated with both said first and said second movable elements and capable of interchangeably retaining both of said first and said second movable elements in their first, second and third positions with respect to said stationary element.

7. The game apparatus of claim 6 further including:

means attaching to each of said first and said second movable elements and exposed outside of said housing such that each of said first and said second movable elements are capable of being moved with respect to said stationary element by manipulation by said latter means with the digits of the player of said game apparatus.

8. The game apparatus of claim 7 wherein:

said retaining means includes biasing means and position means, said biasing means interacting with said positioning means to interchangeably hold each of said first and said second movable elements in their respective first, second and third positions.

9. The game apparatus of claim 8 including:

a first and second biasing means and a first and second positioning means, said first biasing and said first positioning means operatively associated with said first movable element and said second biasing means and said second positioning means operatively associated with said second movable element.

10. The game apparatus of claim 9 wherein:

each of said first and said second positioning means includes a first locating means having three indentations located thereon and a follower means capable of fitting sequentially into each of said indentations, said biasing means biasing said follower means into said indentations.

* * * * *